US005875890A

United States Patent [19]

Di Bernardini

[11] Patent Number: 5,875,890

[45] Date of Patent: Mar. 2, 1999

[54] SOUNDPROOFING BAG FOR SINGLE AND DOUBLE REED INSTRUMENTS, PARTICULARLY FOR A SAXAPHONE

[75] Inventor: Stefano Di Bernardini, Rome, Italy

[73] Assignee: R.D.B. S.A.S. Di Di Bernardini Stefano, Rome, Italy

[21] Appl. No.: 934,848

[22] Filed: Sep. 22, 1997

[51] Int. Cl.[6] ..... A45C 11/00

[52] U.S. Cl. ..... 206/314; 206/502; 206/523; 383/3; 383/41; 190/125

[58] Field of Search ..... 206/314, 522, 206/523; 383/3, 12, 16, 41, 66, 109; 190/112, 113, 117, 119, 125, 903

[56] References Cited

U.S. PATENT DOCUMENTS

| | | | |
|---|---|---|---|
| 3,150,640 | 9/1964 | Nevitt | 190/903 |
| 4,190,152 | 2/1980 | Reiter | 206/314 |
| 4,210,186 | 7/1980 | Belenson | 150/112 |
| 4,569,082 | 2/1986 | Ainsworth et al. | 383/3 |
| 4,573,202 | 2/1986 | Lee | 383/3 |
| 4,756,394 | 7/1988 | Cohen | 190/18 |
| 4,773,515 | 9/1988 | Kotkins, Jr. | 190/103 |
| 5,010,988 | 4/1991 | Brown | 190/104 |
| 5,050,998 | 9/1991 | Wachtel | 383/6 |
| 5,219,075 | 6/1993 | White | 206/314 |
| 5,431,970 | 7/1995 | Broun et al. | 428/36.5 |

*Primary Examiner*—Paul T. Sewell
*Assistant Examiner*—Nhan T. Lam
*Attorney, Agent, or Firm*—Beveridge, DeGrandi, Weilacher & Young, LLP

[57] ABSTRACT

The invention relates to a soundproofing bag (1) for single and double reed instruments, particularly for a saxophone made up of a material providing a fabric outer layer, an intermediate soundproofing layer, and an inner layer made up of air and steam permeable material, shaped in such a way to substantially conform to the shape of the instrument, and provided with a rear opening (9) allowing the hooking of the instrument, of a rear slot (13) for the hooking of the collar (5) to the saxophone, and with two entrances (10, 11), respectively for the introduction of the right and left hands to be able to normally play the saxophone.

18 Claims, 1 Drawing Sheet

FIG. 1
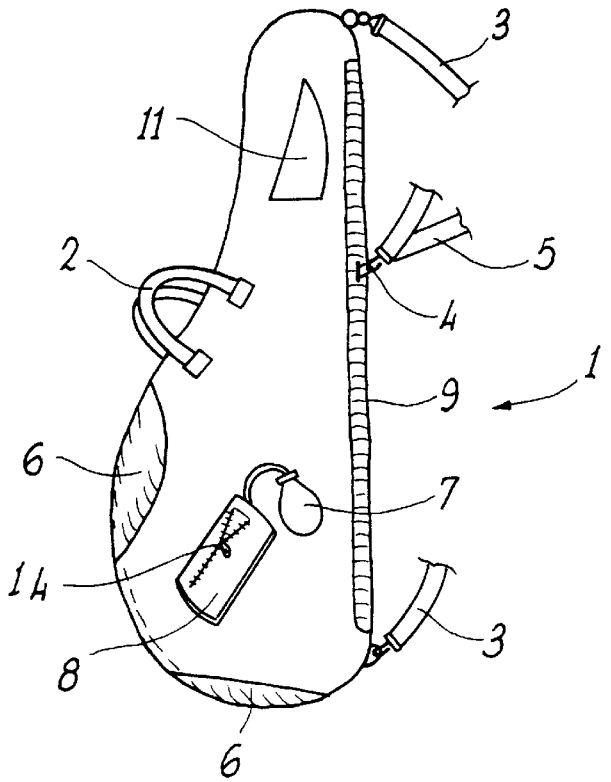
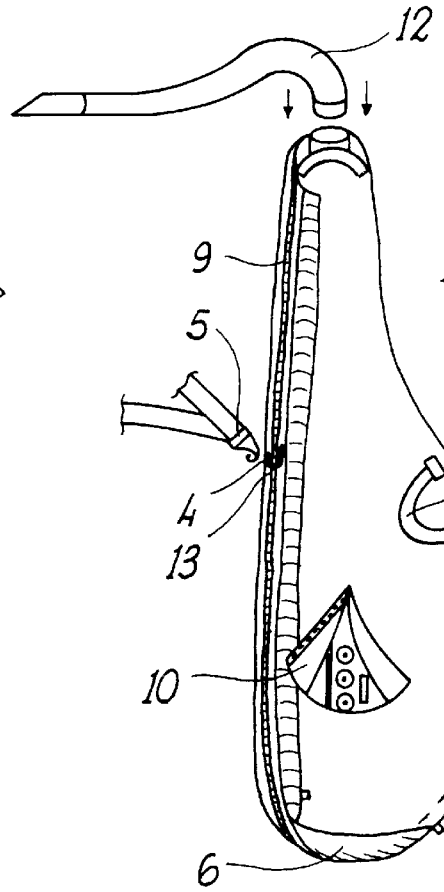
FIG. 2
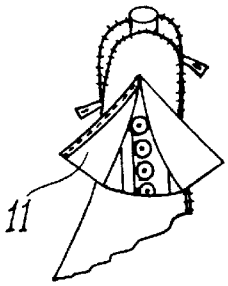
FIG. 3

SOUNDPROOFING BAG FOR SINGLE AND DOUBLE REED INSTRUMENTS, PARTICULARLY FOR A SAXAPHONE

The present invention relates to a soundproofing bag for single and double reed instruments, particularly for a saxophone.

More particularly, the invention relates to a bag of the above kind, allowing to partially or totally soundproofing the same instrument, in case it is wished to play the instrument without troubling too much other people and that can further allow the transportation of the instrument in optimum conditions.

The solution has been suitably studied for single and double reed instruments, particularly for alto, tenor, soprano and baritone, and clarinet.

As it is well known, saxophone is a wind instrument, generating the sound by the vibration of a "reed" provided in the mouthpiece.

The sound, in function of the amount of the dimension of the bell, and particularly of the low range, has a remarkable intensity (even up to 120 dB).

Furthermore, it is also known that in case it is wished to reduce the noise of the instrument, the positioning of the keys all along the surveying, prevents the use of usual mute systems, like those used for trumpets.

Up today, suitable solutions have not been able to reduce the sound emissions of the saxophone.

It is also known that a bag to transport the saxophone, ensuring the integrity of the instrument is needed.

In this situation, the Applicant has realised a solution for a bag that, besides allowing the soundproofing, is able to satisfy the safety and practicality needed during the transportation of the instrument.

These and other results are obtained according to the present invention suggesting a bag which is at the same time safe and light for the transportation of the instrument, which protects the same where it is necessary, and that can also be an attenuator, for all the range of the emitted sound intensity.

Furthermore, the solution suggested according to the present invention is useful for beginners during study, to strengthen the emission and to train the diaphragm, and for those playing the instrument at home, if time does not allow, to avoid troubling other people, and also reducing the condensation phenomenon.

It is therefore a specific object of the present invention, a soundproofing bag for single and double reed instruments, particularly for a saxophone made up of a material providing a fabric outer layer, an intermediate soundproofing layer, and an inner layer made up of air and steam permeable material, shaped in such a way to substantially conform to the shape of the instrument, and provided with a rear opening allowing the hooking of the instrument, of a rear slot for the hooking of the collar to the saxophone, and with two entrances, respectively for the introduction of the right and left hands to be able to normally play the saxophone.

Preferably, according to the invention, said bag is provided with means for transportation, particularly with handles and shoulder strap.

Still according to the invention, shock absorbing pads can be provided on the bag, in correspondence of the most delicate parts of the instrument.

Particularly, said pads can be inflatable by air, preferably by a bellow housed within a housing.

Always according to the invention, a fitting holding pocket can be provided, acting as compensation chamber, said pocket could eventually be the same within which it is provided the bellow.

Still according to the invention, said outer layer of the bag is made up of water proof fabric, while said soundproofing material layer can be made up of sponge rubber, having a density variable in function of the absorption needing.

Furthermore, according to the invention, on the front portion of the bag, in correspondence of the sound emission bell, a bellow fabric portion can be provided, having a pocket with opening and closure means.

The present invention will be now described, for illustrative but not limitative purposes, according to its preferred embodiments, with particular reference to the figures of the enclosed drawings, wherein:

FIG. 1 is a lateral view of an embodiment of a bag according to the invention;

FIG. 2 is a lateral view of the bag of FIG. 1 ready to allow to play the saxophone; and FIG. 3 shows a particular of the bag of FIG. 1.

Observing now the figures, and at the beginning FIG. 1, the bag 1 according to the invention is a case soft and conforming to the profile of the instrument.

Three different kinds of catches are provided on said bag 1, namely the handles 2, the shoulder strap 3 and the hook 4 with the collar 5 for short moving.

Furthermore, pneumatic pads 6 are provided on said bag 1, placed in correspondence of the points much more importance for the integral protection of the instrument, which, co-operating with the composition of the cover, makes the bag particularly reliable against casual shocks.

Said pneumatic pads 6, that could be provided in different positions, can be inflated and deflated by the squirt 7, which in the rest position is housed within the pocket 8 provided with zipper 4.

The lateral pocket 8 provides also the opportunity of placing the fitting elements necessary for the instrument.

A long zipper 9 is provided along the bag 1 to allow the introduction and the removal of the instrument.

The bag 1 according to the invention is made up of a material comprising a preferably waterproof, fabric outer layer, a soundproofing intermediate layer, preferably made up of sponge-rubber, and an inner layer, made up of an air and steam permeable fabric.

As it can be seen from FIGS. 2 and 3, once the instrument safely reached the destination, or in case it is wished to play the instrument at home or in other situations that could trouble other people, it will be sufficient to use the bag 1 suitably prepared.

Two entrances, respectively 10 and 11, are further provided on the bag 1, respectively for the introduction of the right and the left hand to play the instrument still within the bag 1.

Therefore, to play the saxophone it will be sufficient to partially open the rear zipper 9, placing the neck 12, with the opening in the right position.

Then the collar 5 is hooked to the hook 4 of the saxophone through the slot 13 and the pad 6 volume is reduced letting some air exiting.

Now the entrances 10 and 11 are opened to put the hands on the keyboard, and thus it is possible to play the instrument.

If necessary, by the rear zipper 9 it is possible, adjusting its opening, increase or reduce the perceivable sound intensity; In case of complete closure, it will allow to obtain a noise reduction of 50–60% without any instrument timbre and tuning variation.

The present invention has been described for illustrative but not limitative purposes, according to its preferred embodiments, but it is to be understood that modifications and/or changes can be introduced by those skilled in the art without departing from the relevant scope as defined in the enclosed claims.

I claim:

1. A soft soundproofing bag for a single or a double reed instrument comprising a fabric outer layer, an intermediate soundproofing layer adjacent said fabric outer layer, an inner air and steam permeable layer adjacent said intermediate layer substantially conforming to a shape of said instrument, wherein said bag defines an opening for receiving said instrument, wherein said bag defines a slot for hooking a collar to said instrument, and a first receiving means for receiving a first hand and a second receiving means for receiving a second hand for playing said instrument.

2. The soundproofing bag defined in claim 1, further comprising a transporting means for transporting said bag.

3. The soundproofing bag defined in claim 2, wherein said transporting means includes at least one handle or strap.

4. The soundproofing bag defined in claim 2, wherein said fabric outer layer is a water proof material, and wherein said soundproofing layer is sponge rubber.

5. The soundproofing bag defined in claim 2, further comprising a bellow fabric portion on said bag having a pocket comprising an opening means and a closing means.

6. The soundproofing bag defined in claim 1, further comprising a shock absorbing means on said bag.

7. The soundproofing bag defined in claim 6, wherein said shock absorbing means include an inflation means for inflating said shock absorbing means.

8. The soundproofing bag defined in claim 7, wherein said inflation means further comprises a bellow housed within a housing.

9. The soundproofing bag defined in claim 6, further comprising a transporting means for transporting said bag.

10. The soundproofing bag defined in claim 6, wherein said fabric outer layer is a water proof material, and wherein said soundproofing layer is sponge rubber.

11. The soundproofing bag defined in claim 6, further comprising a bellow fabric portion on said bag having a pocket comprising an opening means and a closing means.

12. The soundproofing bag defined in claim 1, further comprising a pocket on said bag for receiving said bellow or for receiving fitting elements, or both.

13. The soundproofing bag defined in claim 12, further comprising a transporting means for transporting said bag, and a shock absorbing means on said bag.

14. The soundproofing bag defined in claim 12, wherein said fabric outer layer is a water proof material, and wherein said soundproofing layer is sponge rubber.

15. The soundproofing bag defined in claim 12, further comprising a bellow fabric portion on said bag having a pocket comprising an opening means and a closing means.

16. The soundproofing bag defined in claim 1, wherein said fabric outer layer is a water proof material, and wherein said soundproofing layer is sponge rubber.

17. The soundproofing bag defined in claim 1, further comprising a bellow fabric portion on said bag having a pocket comprising an opening means and a closing means.

18. The soundproofing bag defined in claim 1, further comprising a transporting means for transporting said bag, a shock absorbing means on said bag, wherein said shock adsorbing means further comprises an inflation means having a bellow housed within a housing, wherein said fabric outer layer is a water proof material, wherein said soundproofing layer is sponge rubber, and a bellow fabric portion on said bag having a pocket comprising an opening means and a closing means.

* * * * *